US005756944A

United States Patent [19]

Bättig et al.

[11] Patent Number: 5,756,944

[45] Date of Patent: May 26, 1998

[54] FILTER MUFFLER

[75] Inventors: Josef Bättig, Egliswil; Reto Meier, Döttingen, both of Switzerland

[73] Assignee: Asea Brown Boveri AG, Baden, Switzerland

[21] Appl. No.: 609,688

[22] Filed: Mar. 1, 1996

[30] Foreign Application Priority Data

Apr. 24, 1995 [DE] Germany ..... 195 14 990.4

[51] Int. Cl.[6] ..... F02M 35/00

[52] U.S. Cl. ..... 181/229; 181/257; 181/268; 181/279

[58] Field of Search ..... 181/229, 230, 181/231, 224, 214, 219, 222, 256, 257, 258, 264, 268, 279, 280

[56] References Cited

U.S. PATENT DOCUMENTS

| | | | |
|---|---|---|---|
| 4,204,586 | 5/1980 | Hani et al. | 181/229 |
| 4,266,602 | 5/1981 | White et al. | 181/224 X |
| 4,316,522 | 2/1982 | Hirschorn | 181/224 |

FOREIGN PATENT DOCUMENTS

| | | |
|---|---|---|
| 0574605A1 | 12/1993 | European Pat. Off. . |
| 2305178 | 8/1974 | Germany . |
| 2547611 | 4/1977 | Germany . |
| 2600860 | 6/1977 | Germany . |

*Primary Examiner*—Khanh Dang
*Attorney, Agent, or Firm*—Burns, Doane, Swecker & Mathis, L.L.P.

[57] ABSTRACT

A circular-cylindrical filter muffler includes damping elements (3) arranged with their damping surfaces (11, 12) parallel to the central axis (13) of the filter muffler housing (2), which is cast as a monobloc. The damping elements are arranged in grooves (8) of the housing walls. The damping elements (3) include a damping plate (9) which encases an absorption element (10). In the assembled state the damping plates (9) form, with the coarse filter segments (15) arranged on them on the circumference of the filter muffler, a coarse filter ring which is surrounded by an annular filter (4). The advantages of the invention are, in addition to the simplified production and assembly of the components, the reduction of different components and the lower weight along with improved muffling.

9 Claims, 6 Drawing Sheets

FILTER MUFFLER

BACKGROUND OF THE INVENTION

1. Field of the Invention

The invention relates to a filter muffler.

2. Discussion of Background

A filter muffler of this general type is know, for example, from EP 0.574.605 A1. Filter mufflers of this type are used, for example, on the intake side of a compressor which compresses combustion air and which feeds it to an internal combustion engine. A compressor of this type is driven by the exhaust-gas turbine of an exhaust-gas turbocharger. In this case, sound waves of undesirably high amplitude occur predominantly in the compressor impeller and are released into the environment through the air intake duct. These soundwaves are therefore usually damped by means of a muffler. For this purpose, ambient air flows through a filter, arranged on the circumference of a muffler, into the muffler interior equipped with damping elements, subsequently flows past the damping elements, and is deflected by guide elements to the compressor impeller, from which sound waves emanate in the opposite direction to the airflow. Muffling takes place on the damping elements by dissipation, in that the sound energy is converted directly into heat by means of porous or fibrous absorption materials, of which the damping elements are essentially composed. The abovementioned EP 0.574.605 A1 describes a filter muffler which consists of a cast monobloc and in the radiated ribs of which, having grooves, the damping elements are arranged. A filter frame, consisting of a removable perforated plate part, surrounds the muffler in such a way that the damping elements are secured against falling out radially. The perforated plate part is arranged annularly around the muffler by means of connecting elements. A disk-shaped damping element consists of four damping segments which, when assembled, form an annular surface. An absorption element is held by two punched perforated plates and thus forms a damping segment which is introduced radially into the grooves of the abovementioned ribs of the cast monobloc.

The edges of the damping segments punched from the perforated plate have an adverse effect on the design of this filter muffler. These edges of the damping segments, having the form of ring segments, are not treated further after being punched out and therefore have isolated plate webs on account of the plate perforation. These plate webs may break off as a result of mechanical vibrations, to which the filter muffler as a whole is exposed, and the broken-off pieces may subsequently pass, together with intake air, into the compressor and into the combustion space of an internal combustion engine and damage the latter. At the locations where plate webs are broken out, the damping material then swells and consequently impairs the flow properties of the air inlet ducts. The deflection by guide elements on the damping elements have a further unfavorable effect on the flow properties of the air, since compression losses of undesirable magnitude occur as a result of said guide elements.

SUMMARY OF THE INVENTION

The object on which the invention is based is to develop further a filter muffler of the initially mentioned type, to the effect that the abovementioned disadvantages are reduced or avoided. At the same time, the damping properties of the muffler are to be improved, and the outlay in terms of manufacture and of assembly is to be reduced.

The advantages of the invention are to be seen, inter alia, in that now only damping elements which are of identical type are used and, at the same time, now only consist of two parts, namely a damping plate and an absorption element. The reduction in the number of different components is advantageous particularly with regard to the logistic outlay.

The closed edges of the damping plates are likewise advantageous, the edges extending along the perforated plate webs and therefore having no isolated plate webs.

The coarse filter which surrounds the filter muffler is divided segmentally, and the segments are arranged on the damping plates, so that the coarse filter as an individual component is dispensed with.

Advantageous, furthermore, is the arrangement of a cast-in tube as a washing device for the compressor impeller in the housing wall of the connection side of the filter muffler.

This tube is connected to a supply conduit which does not have to be guided round the muffler, as in conventional mufflers, because the connection of the supply conduit to the washing device is arranged on the closing-off side of the filter muffler.

It is advantageous, furthermore, that the air is guided between adjacent damping plates in muffler ducts of constant cross section, and therefore, during intake, the air experiences a constant velocity, with the result that only minor compression losses occur.

It is particularly expedient if, on account of the good damping properties, an open-cell foam with high elasticity is used as an absorption material in the damping elements. In comparison with wool felt as an absorption material, an appreciable reduction in weight of the filter muffler as a whole is achieved at the same time with this type of foam.

BRIEF DESCRIPTION OF THE DRAWINGS

A more complete appreciation of the invention and many of the attendant advantages thereof will be readily obtained as the same becomes better understood by reference to the following detailed description when considered, in connection with the accompanying drawings wherein the invention is explained below by means of diagrammatic representations of an exemplary embodiment.

In the drawings.

Only the elements essential for understanding the invention are shown. What is not shown is, for example, the arrangement of the filter muffler on the compressor side of a turbocharger and the connection of a washing device for a compressor impeller.

DESCRIPTION OF THE PREFERRED EMBODIMENTS

Figure 1:
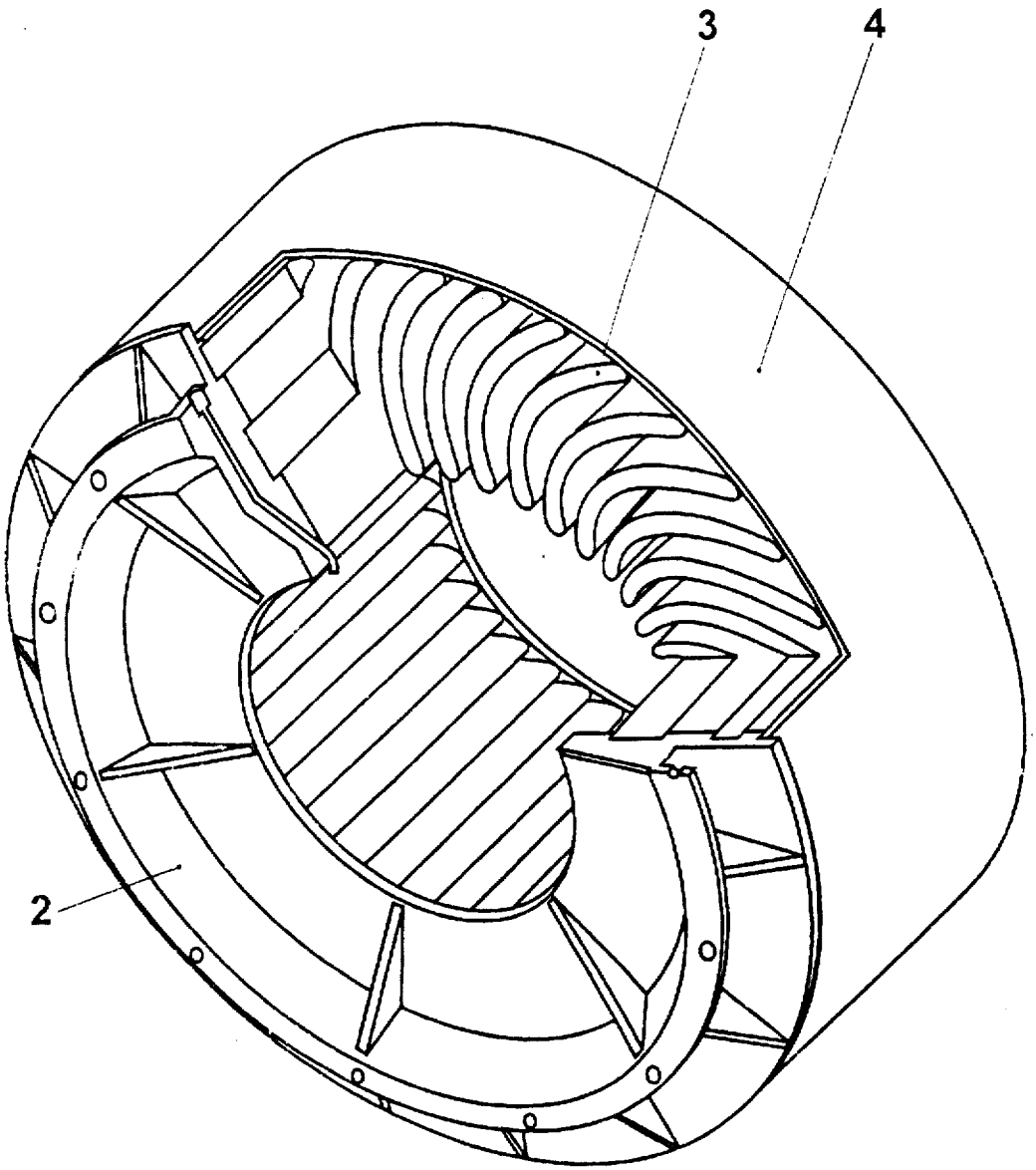
FIG. 1 shows a part segmental section through a filter muffler.
Figure 2:
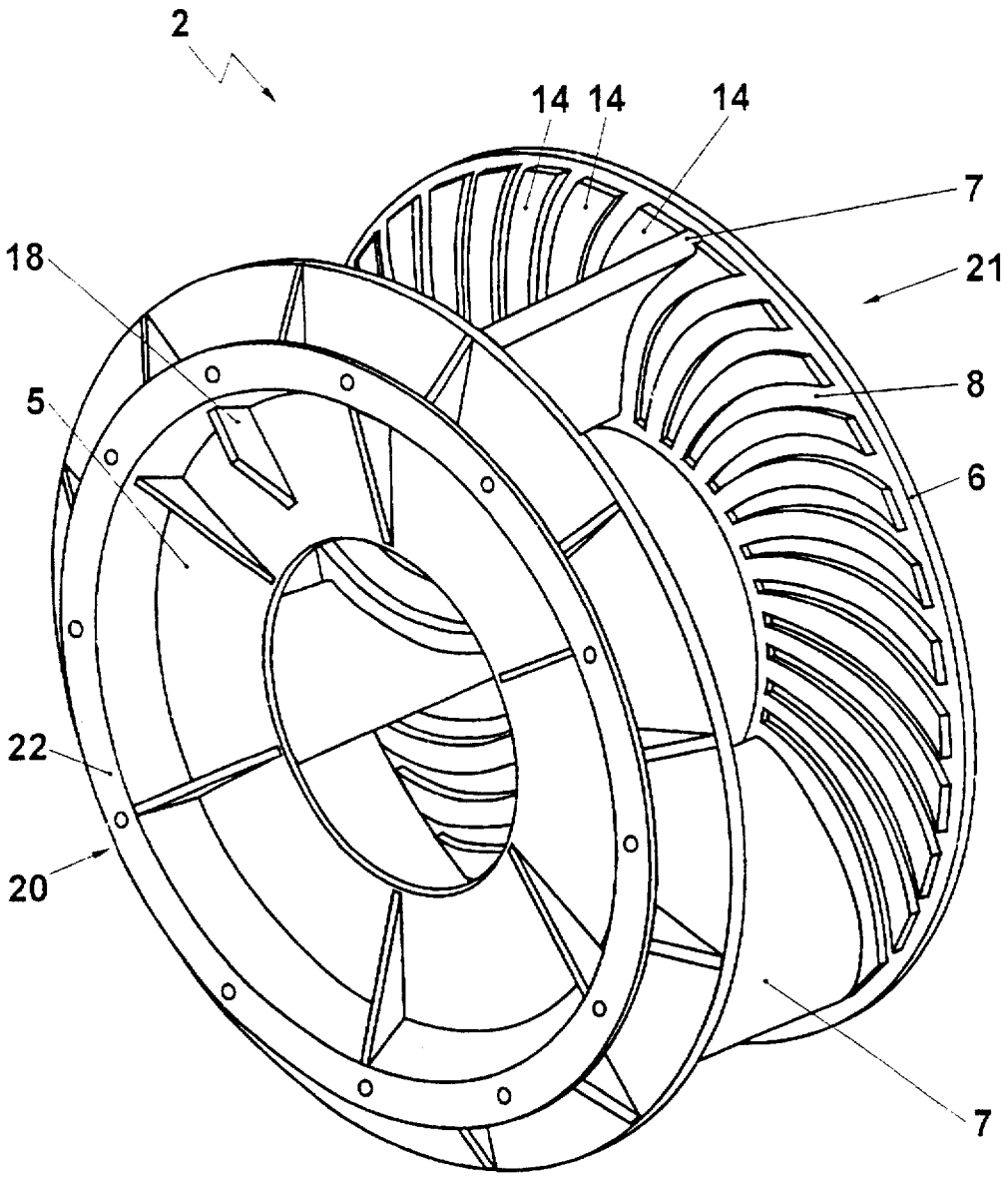
FIG. 2 shows a view of the filter muffler housing from the connection side.

Referring now to the drawings, wherein like reference numerals designate identical or corresponding parts throughout the several views, in FIG. 1 there is a circular-cylindrical filter muffler which is composed essentially of a housing 2, of a number of damping elements 3, here thirty three, and of a filter 4. FIG. 2 shows the housing 2 which is cast as a monobloc from aluminum and of which the housing wall 5 on the connection side 20 of the filter muffler is connected by means of connecting webs 7 to the housing wall 6 on the closing-off side 21. Cast in on the insides of the housing walls 5, 6 are grooves 8 in the form of an arc of a circle which narrow towards the inner radius of the filter muffler. The cross sectional area of the connecting web 7 is equal in form and curvature to a groove 8, and the distribution of the thirty three grooves 8 and of the three connecting webs 7 takes place uniformly over the circumference of the housing in a 10° division. Arranged between adjacent grooves 8 and between grooves 8 and an adjacent connecting web 7 are webs 14 which have a constant width from the outer circumference of the housing 2 toward to the inner radius. Arranged on the connection side 20 is a connection flange 22, by means of which the filter muffler is mounted on the compressor side of an exhaust-gas turbocharger (not shown here).

Figure 3:
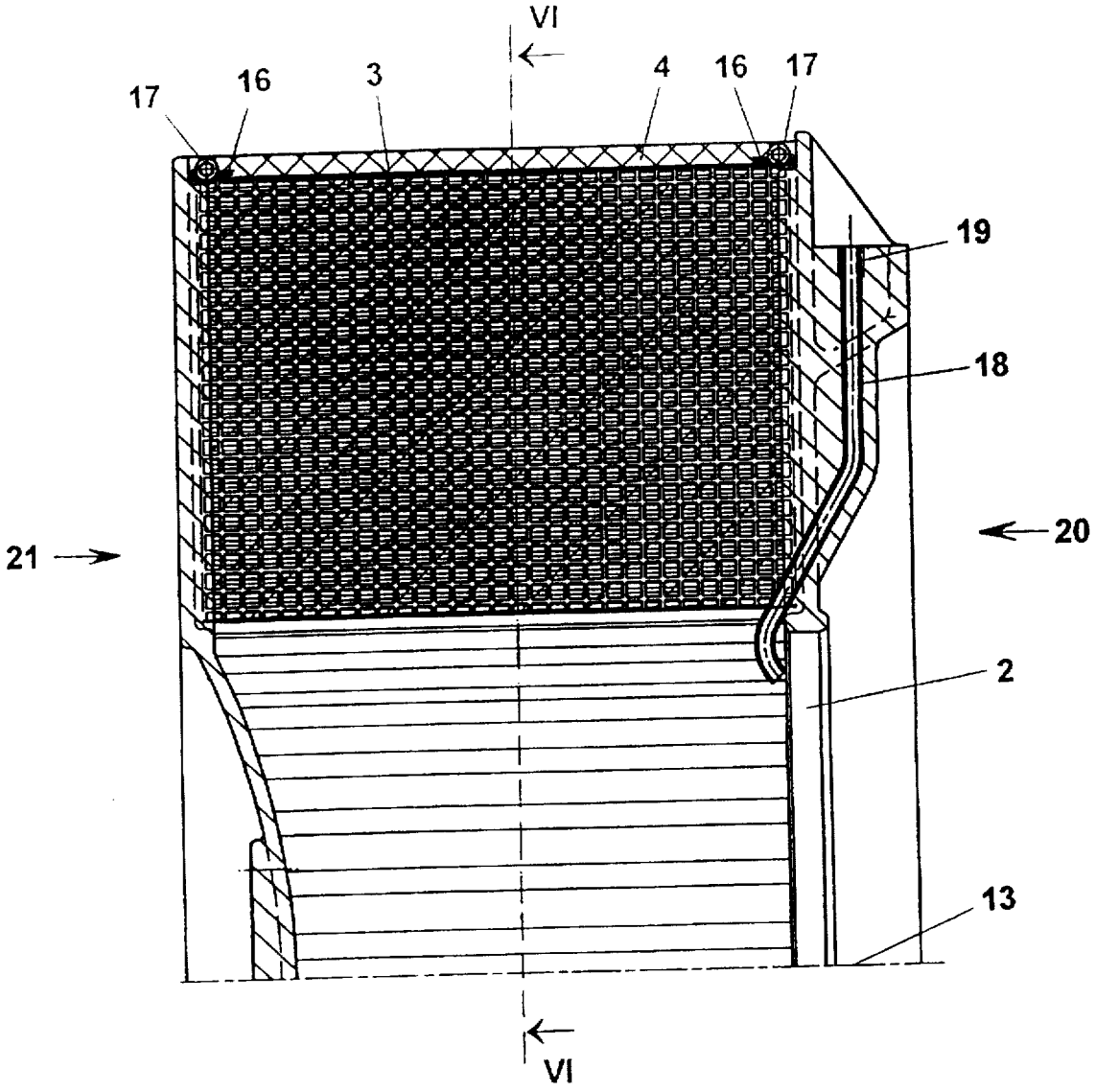
FIG. 3 shows a part longitudinal section through the filter muffler.

As shown in FIG. 3, a tube 18 with a thread 19 is cast in in the radial direction into the housing wall 5 on the connection side 20, said tube being angled towards the connection side 20 at the end pointing to the central axis 13 of the housing 2. This tube serves as a washing device for the compressor impeller (not shown), and is connected directly, by the thread 19, to a conduit (not shown) on the connection side 20 of the filter muffler. The damping elements 3 are secured against falling out by tightening straps 16 which are closed on the circumference of the housing 2 by means of quick-action fastenings 17. The filter muffler is surrounded on its circumference by an annular filter 4 made of polyurethane foam (PU foam), which filters out particles in ambient intake air. In the unassembled state, the inner circumference of the annular filter 4 is smaller than the outer circumference of the filter muffler, so that the filter 4, which is produced elastomerically from PU foam, is fixed to the circumference of the muffler by spring force.

Figure 4:
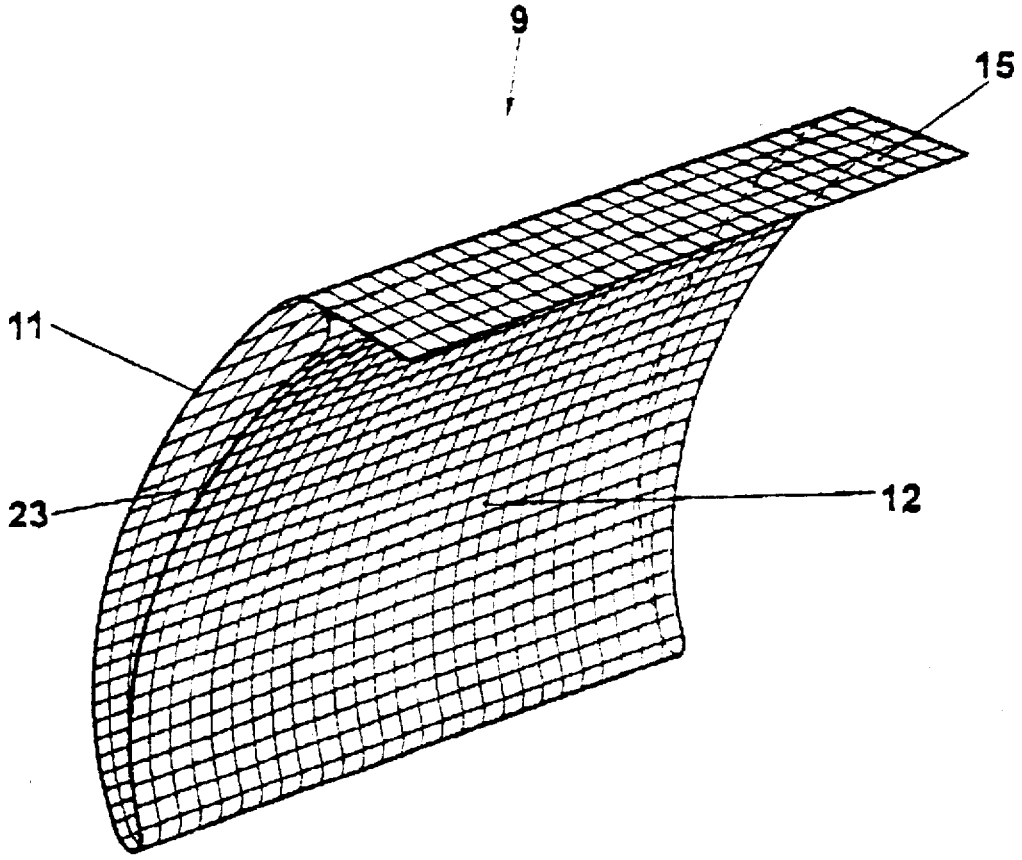
FIG. 4 shows a view of a damping plate.
Figure 5:
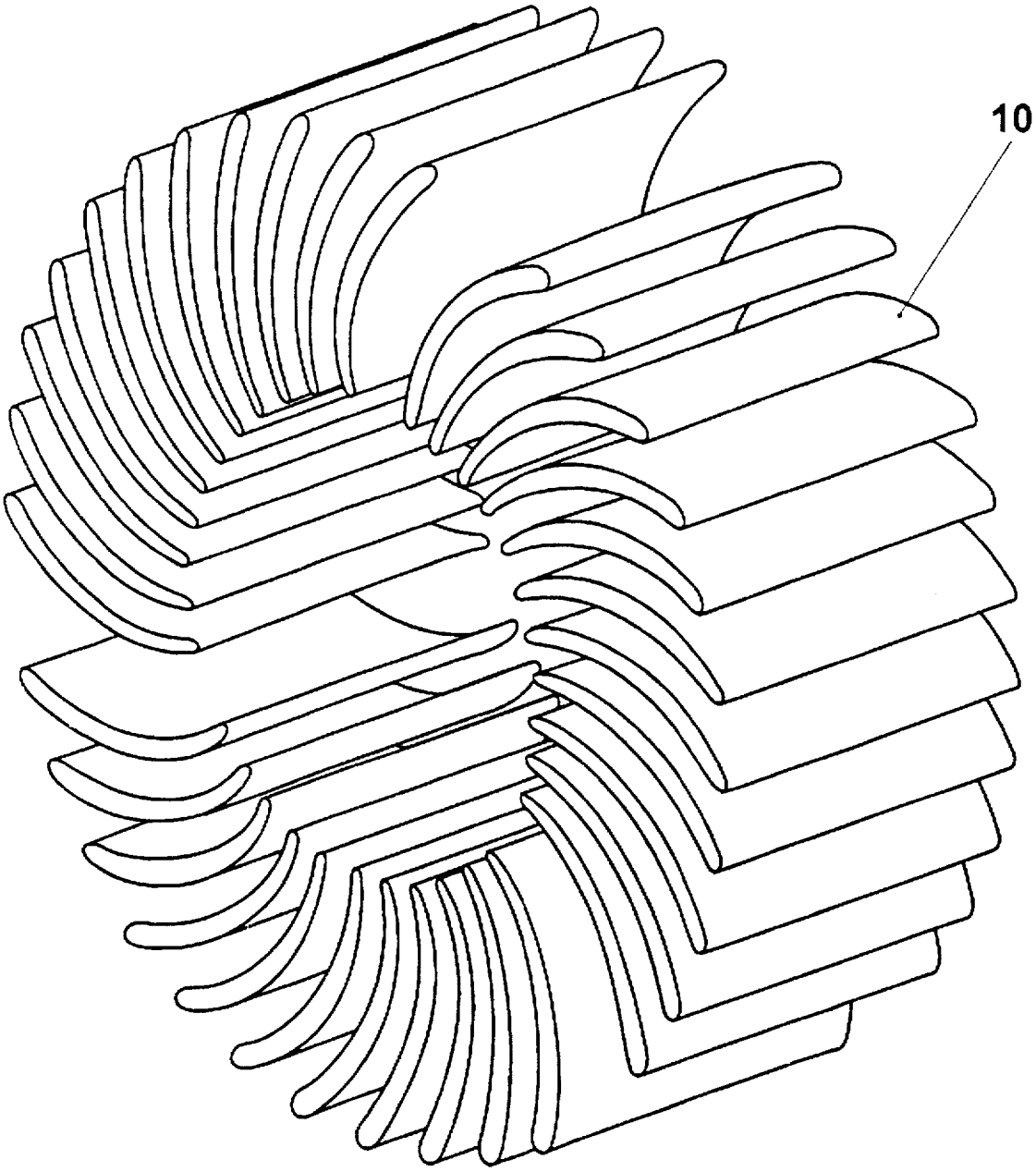
FIG. 5 shows a view of an arrangement of absorption elements.

FIGS. 4 and 5 show the two components of a damping element 3, namely a damping plate 9 and an absorption element 10. During manufacture, the damping plate 9 is punched in the form of a rectangle from perforated plate with square holes along the perforation webs and therefore has no isolated webs. The rectangular perforated plate is subsequently bent in such a way as to form a concave surface 12 which has a convex surface 11 adjoining it. The convex surface 11 has adjoining it a plane surface 15 which is bent as a coarse filter segment 15. The concave surface 12 and the convex surface 11 extend approximately parallel and form an interspace 23, into which the absorption element 10, FIG. 5, is inserted. An absorption element 10 is thicker than the interspace 23, so that, when the absorption element 10 is inserted into the interspace 23, the surfaces 11, 12 are to be bent apart elastically. After the insertion of the absorption elements 10 into the interspace 23, these are clamped, on account of their thickness, between the surfaces 11, 12. The material used for an absorption element 10 is an open-cell foam which, whilst having identical damping properties, has only approximately 6% of the specific gravity of conventional absorption materials, such as wool felt. The absorption elements 10 shown in FIG. 5 are cut out rectangularly from foam boards and are shown here merely bent, as in their installed state.

Figure 6:
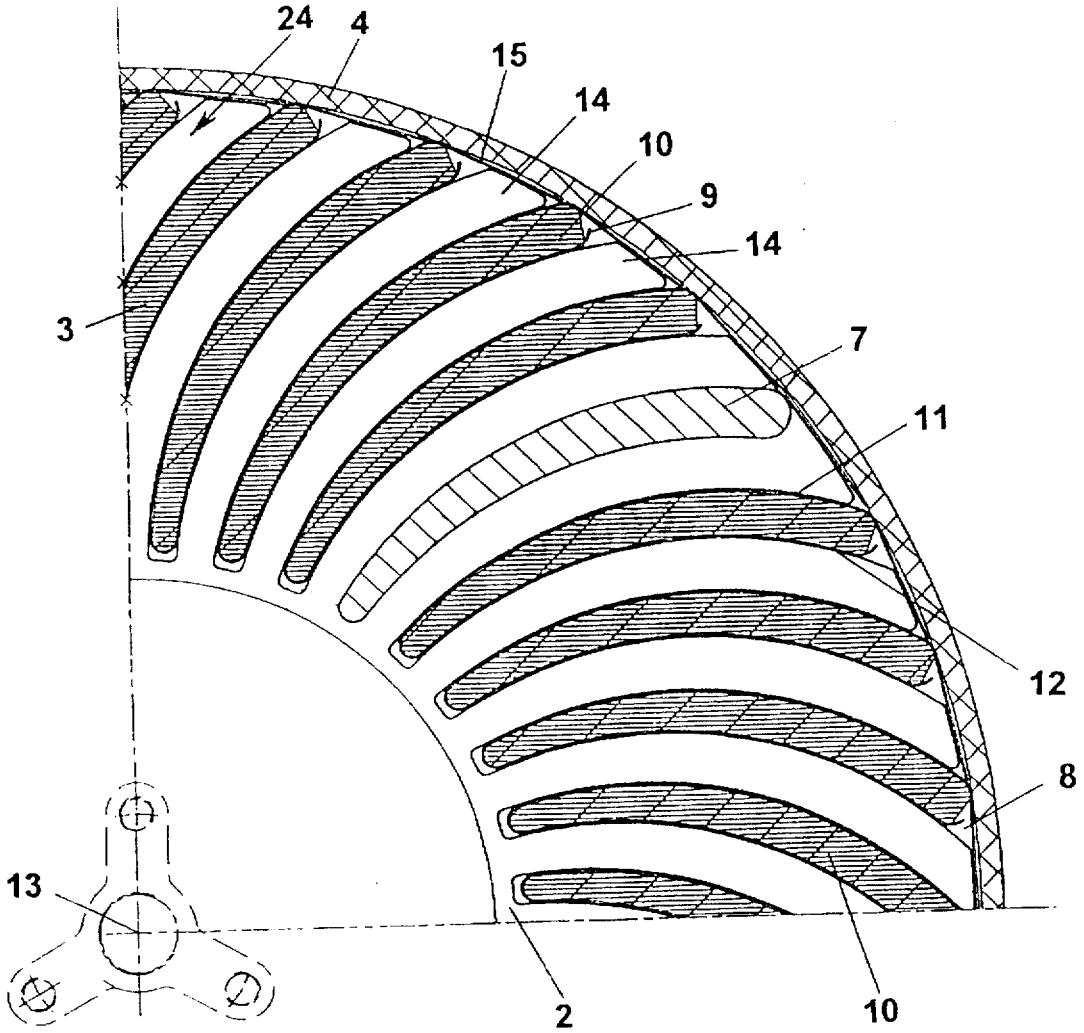
FIG. 6 shows a partial cross section through the filter muffler along the line VI—VI according to FIG. 3.

FIG. 6 shows, by means of a cross sectional segment of a filter muffler, the arrangement of the damping elements 3, consisting of the damping plate 9 and of the absorption element 10, in the circular-cylindrical housing 2 having the central axis 13. The damping elements 3 are pushed radially into the grooves 8 and are arranged in such a way that their damping surfaces 11, 12 extend parallel to the central axis 13 of the housing 2. The width of the webs 14 and therefore also the cross sectional area of the air inlet ducts 24 between adjacent damping elements 3 are constant from the outer circumference of the filter muffler towards the central axis 13, thereby guaranteeing a constant velocity of ambient intake air. As a result of this arrangement, compression losses, such as occur in conventional muffler systems, are reduced. On the outer circumference of the housing 2, the coarse filter segments 15 of the installed damping plates 9 are assembled to form a coarse filter ring, so that a coarse filter as an individual component is dispensed with. An arrangement in the form of an arc of a circle of the damping elements 3 in the housing 2 lengthens the air inlet ducts 24 and therefore the path of the sound waves in comparison with air inlet ducts extending purely radially, such as occur in conventional filter mufflers having the same outer circumference. This lengthening of the damping path alone, along with the same dimensions as conventional filter mufflers, improves the muffling.

Altogether, the reduction in components and the use of melamine foam as an absorption material not only achieve a decrease in the total weight of the filter muffler by approximately 20%, but at the same time reduce the logistic outlay.

Of course, the invention is not restricted to the exemplary embodiment shown and described. Thus, for example, the use of damping and filter materials other than those described above is likewise conceivable within the meaning of the invention.

Obviously, numerous modifications and variations of the present invention are possible in light of the above teachings. It is therefore to be understood that, within the scope of the appended claims, the invention may be practiced otherwise than as specifically described herein.

LIST OF DESIGNATIONS

| | |
|---|---|
| 2 | Housing |
| 3 | Damping element |
| 4 | Filter |
| 5 | Housing wall on the connection side |
| 6 | Housing wall on the closing-off side |
| 7 | Connecting webs for 5, 6 |
| 8 | Grooves for 3 |
| 9 | Damping plate |
| 10 | Absorption element |
| 11 | Convex damping surface |
| 12 | Concave damping surface |
| 13 | Central axis |
| 14 | Web between two grooves |
| 15 | Coarse filter segment |
| 16 | Tightening strap |
| 17 | Quick-action fastening |
| 18 | Tube |
| 19 | Internal thread in 18 |
| 20 | Connection side |
| 21 | Closing-off side |
| 22 | Connection flange |
| 23 | Interspace |
| 24 | Air inlet duct |

What is claimed as new and desired to be secured by Letters Patent of the United States is:

1. A filter muffler comprising:

a housing including a central axis, housing walls, and a plurality of radial grooves formed in said housing walls;

a plurality of damping elements, each of said plurality of damping elements including damping surfaces, a damping plate, and an absorption element, each said damping plate surrounding a corresponding absorption element, said plurality of damping elements arranged in said plurality of radial grooves with said damping surfaces oriented parallel to said housing central axis.

2. The filter muffler according to claim 1, wherein said damping elements and said radial grooves are in the form of an arc of a circle.

3. The filter muffler according to claim 1, further comprising air inlet ducts having a constant cross section formed between adjacent damping elements.

4. The filter muffler according to claim 1, wherein said absorption element comprises a foam.

5. The filter muffler according to claim 1, further comprising coarse filter segments arranged on said damping plates which form an annular coarse filter when said damping elements are arranged in said radial grooves.

6. The filter muffler according to claim 5, further comprising tightening straps including quick-action fastenings arranged around said annular coarse filter.

7. The filter muffler according to claim 1, further comprising an annular filter comprising PU foam arranged on the circumference of the filter muffler.

8. The filter muffler according to claim 1, wherein said housing has a circular-cylindrical form.

9. The filter muffler according to claim 1, further comprising a tube including an internal thread arranged radially in said housing wall.

* * * * *